US007893629B2

(12) United States Patent
Yang et al.

(10) Patent No.: US 7,893,629 B2
(45) Date of Patent: Feb. 22, 2011

(54) BACKLIGHT APPARATUS CAPABLE OF SHORT PREVENTION AND VOLTAGE FEEDBACK COMPENSATION

(75) Inventors: Ming-Yan Yang, Taoyuan (TW); Chin-Long Yang, Bade (TW); Chao-Jung Lin, Bade (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 355 days.

(21) Appl. No.: 12/187,914

(22) Filed: Aug. 7, 2008

(65) Prior Publication Data

US 2009/0184657 A1 Jul. 23, 2009

(30) Foreign Application Priority Data

Jan. 18, 2008 (TW) ..... 97201114 U

(51) Int. Cl.
*H05B 41/16* (2006.01)

(52) U.S. Cl. ..... 315/282; 315/277; 315/291; 315/247; 315/312

(58) Field of Classification Search ..... 315/274–289, 315/291, 297, 307–311, 247, 224, 246
See application file for complete search history.

(56) References Cited

U.S. PATENT DOCUMENTS 7,439,689 B2 * 10/2008 Honda et al. ..... 315/307
2004/0100740 A1 * 5/2004 Iwashita ..... 361/18
2009/0115339 A1 * 5/2009 Kim et al. ..... 315/210
2009/0309508 A1 * 12/2009 Hung ..... 315/255
2010/0020269 A1 * 1/2010 Fukumoto ..... 349/70
2010/0171439 A1 * 7/2010 Kobayashi et al. ..... 315/291

FOREIGN PATENT DOCUMENTS

KR 1020040030260 A 4/2004
KR 1020040100861 A 12/2004

* cited by examiner

*Primary Examiner*—Tuyet Thi Vo
(74) *Attorney, Agent, or Firm*—Winston Hsu; Scott Margo

(57) ABSTRACT

The invention discloses a backlight apparatus. The backlight apparatus includes a power source, a lamp, a balance transformer, a detecting circuit, a judging module, and a controlling module. The balance transformer includes a primary winding electrically connected to the power source and a secondary winding corresponding to the primary winding and electrically connected to the lamp. The detecting circuit is used for detecting a current generated by the secondary winding and generating a first voltage according to the current. The judging module is used for judging whether the value of the first voltage is smaller than a default value. The controlling module is used for controlling the power source according to a judgment made by the judging module.

2 Claims, 6 Drawing Sheets

BACKLIGHT APPARATUS CAPABLE OF SHORT PREVENTION AND VOLTAGE FEEDBACK COMPENSATION

BACKGROUND OF THE INVENTION

1. Field of the Invention

The invention relates to a backlight apparatus and, more particularly, to a backlight apparatus, without additional capacitors, capable of short prevention and voltage feedback compensation by means of changing the connecting pattern of a balance transformer circuit.

2. Description of the Prior Art

With the development of ever-enlarging size of Liquid Crystal Display (LCD) panel recently, a backlight apparatus with multiple Cold Cathode Fluorescent Lamps (CCFLs) has been broadly applied as a high quality optical source for LCD panel.

Please refer to FIG. 1. FIG. 1 is a schematic diagram illustrating a backlight apparatus of prior art with a balance circuit capable of short prevention and voltage feedback compensation. As shown in FIG. 1, the backlight apparatus 1, which is installed on a double-sided printed circuit board (PCB), treats multiple capacitors and resistors as voltage dividers on a secondary side of the balance circuit of a balance transformer 14. A voltage of node A in FIG. 1 is measured and compared to a default value for judging whether the balance circuit is short or not. In addition, at the node B in FIG. 1, a kick-off voltage is measured for adjusting voltage provided by a power source 10, so as to achieve voltage feedback compensation.

In the aforesaid balance circuit, a lot of capacitors and resistors are needed to achieve short prevention and voltage feedback compensation. However, the additional components are increasing the complexity of circuit and the cost of product. Besides, because that the capacitors used in the double-sided PCB are not adapted to the single-sided PCB. Therefore, a backlight apparatus on single-sided PCB is unable to achieve the short prevention and voltage feedback compensation by the prior art.

The invention discloses a backlight apparatus, without additional capacitors, capable of short prevention and voltage feedback compensation by means of changing the connecting pattern of a balance transformer circuit, so as to solve the aforesaid problems.

SUMMARY OF THE INVENTION

A scope of the invention is to provide a backlight apparatus. According to an embodiment, the backlight apparatus comprises a power source, a lamp, a balance transformer, a detecting circuit, a judging module, and a controlling module.

The balance transformer comprises a primary winding and a secondary winding. The primary winding is electrically connected to the power source. The secondary winding is electrically connected to the lamp and corresponding to the primary winding. The detecting circuit, electrically connected to the secondary winding, is used for detecting a current and generating a first voltage according to the current, which is generated by the secondary winding. The judging module, electrically connected to the detecting circuit, is used for judging whether value of the first voltage is smaller than a default value. The controlling module, electrically connected to the power source and the judging module, is used for controlling the power source according to a judgment of the judging module.

Compared to the prior art, the backlight apparatus of the invention can achieve short prevention in balance circuit and real signal voltage feedback compensation in close loop of a single-sided printed circuit board (PCB). Most importantly, the backlight apparatus of the invention can achieve the aforesaid ambition only by changing the connecting pattern of balance transformer circuit. Therefore, it can save a lot of capacitors and resistors and reduce product cost.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
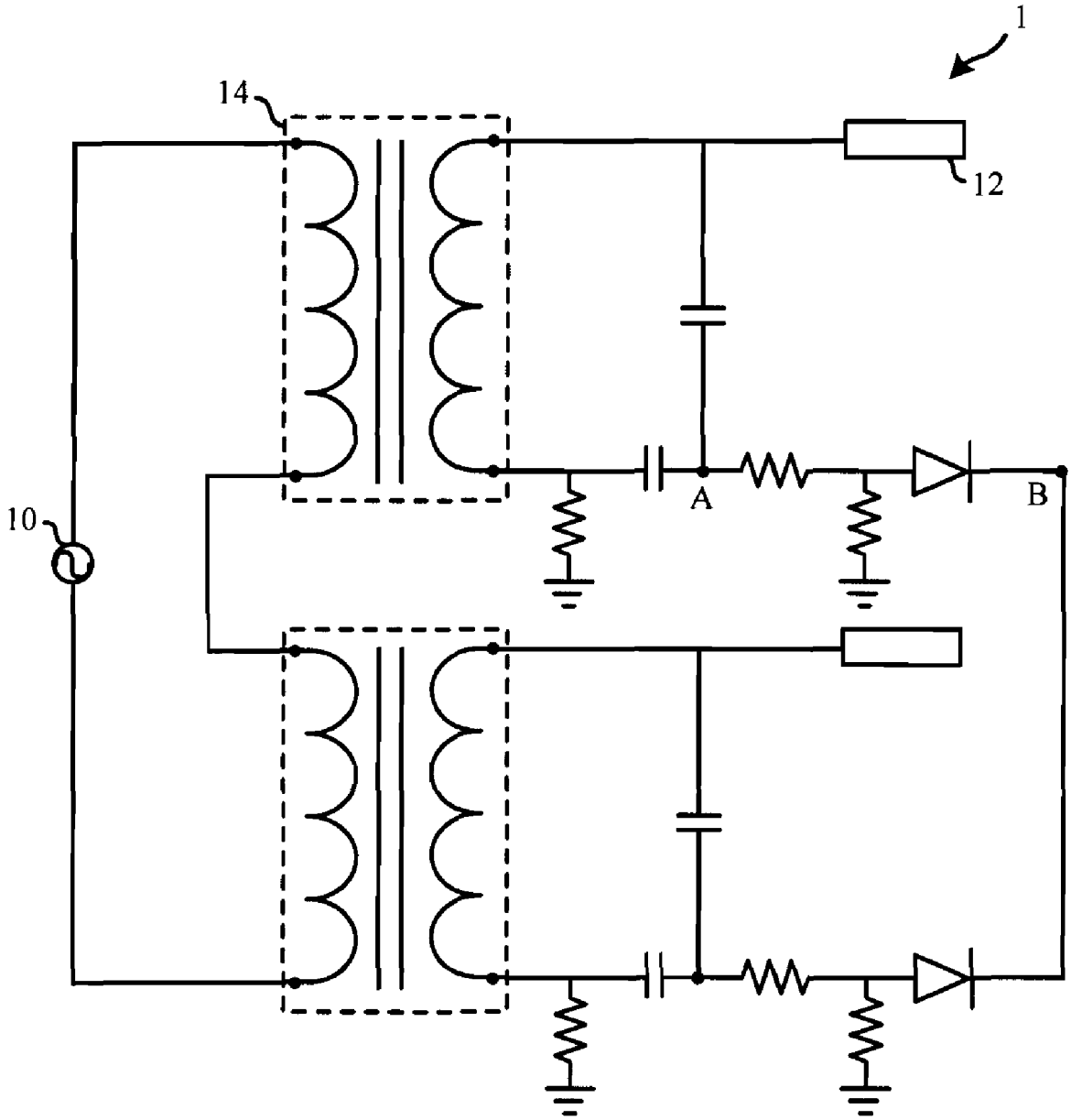
FIG. 1 (prior art)
FIG. 1 is a schematic diagram illustrating a backlight apparatus of prior art with a balance circuit capable of short prevention and voltage feedback compensation.
Figure 2:
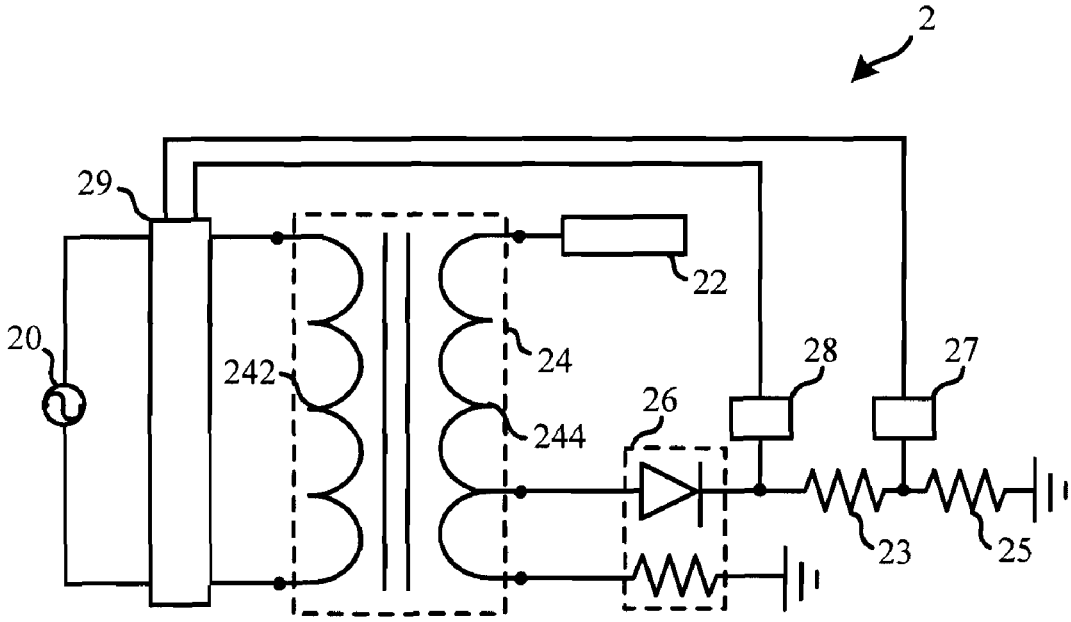
FIG. 2 is a schematic diagram illustrating a first embodiment of a backlight apparatus.

A first embodiment of the invention is a backlight apparatus. Please refer to FIG. 2. FIG. 2 is a schematic diagram illustrating a first embodiment of a backlight apparatus.

The backlight apparatus 2 comprises a power source 20, a lamp 22, a balance transformer 24, a detecting circuit 26, a judging module 28, a first impedance 23, a second impedance 25, a measuring module 27, and a controlling module 29. Due to that the balance transformer 24 is only corresponding to singular lamp (lamp 22), the balance transformer 24 is one-balance-transformer-to-one-lamp (singular to singular).

The following is a detailed introduction to the mutual relationship and function of each unit included in the multi-lamp backlight apparatus 2.

The balance transformer 24 comprises a primary winding 242 and a secondary winding 244. The primary winding 242 is electrically connected to the power source 20. The secondary winding 242, corresponding to the primary winding 242, is electrically connected to the lamp 22.

In FIG. 2, the detecting circuit 26, electrically connected to the secondary winding 244 of the balance transformer 24, is used for detecting a current and generating a first voltage according to the current, which is generated by the secondary winding 244. In fact, the current in secondary winding 244 is an induction current derived from a current through primary winding 242, which causes an induction to the secondary winding 244.

It should be noticed that the detecting circuit 26 adopts center-tapped connecting pattern to connect with the secondary winding 244 of balance transformer 24. In practical application, a connecting terminal, branched out from the middle of the secondary winding 244, forms an upper part of winding and a lower part of winding from the secondary winding 422 in a proportion around 100:1.

The judging module 28, which is electrically connected to the detecting circuit 26, is used for judging whether the value of the first voltage is smaller than a default value. In practical application, with the default value assumed as zero, if a judgment made by the judging module 28 is positive, it represents that the value of the first voltage is zero, in other words, the detecting circuit 26 is short.

The controlling module 29, which is electrically connected to the power source 20 and judging module 28, is used for controlling the power source 20 according to the judgment of judging module 28. In practical application, the controlling module may comprise a full-bridge circuit or a half-bridge circuit. If the judgment of judging module 28 is positive, which means that the detecting circuit 26 is short, the controlling module 29 will turn off the power source 20 to protect the backlight apparatus 2.

Besides, the backlight apparatus further comprises the first impedance 23, the second impedance 25, and measuring module 27, as shown in FIG. 2. In practical application, the first impedance 23 and the second impedance 25 may each be a resistor component.

The first impedance 23 is electrically connected to the secondary winding 244, which generates a current through the first impedance 23. The second impedance 25 is coupled to the first impedance 23.

The measuring module 27, which is coupled between the first impedance 23 and the second impedance 25, is used for measuring value of a second voltage between the first impedance 23 and the second impedance 25. In fact, the value of the second voltage measured by the measuring module 27 is a kick-off voltage value. The kick-off voltage value is a minimum voltage value to activate the lamp 22.

The controlling module 29, which is electrically connected to the power source 20 and the measuring module 27, is used for controlling the voltage, provided by the power source 20, according to the value of the second voltage. In this way, the voltage feedback compensation is achieved in close loop. In fact, controlling module may comprise a full-bridge circuit or a half-bridge circuit.

Figure 3:
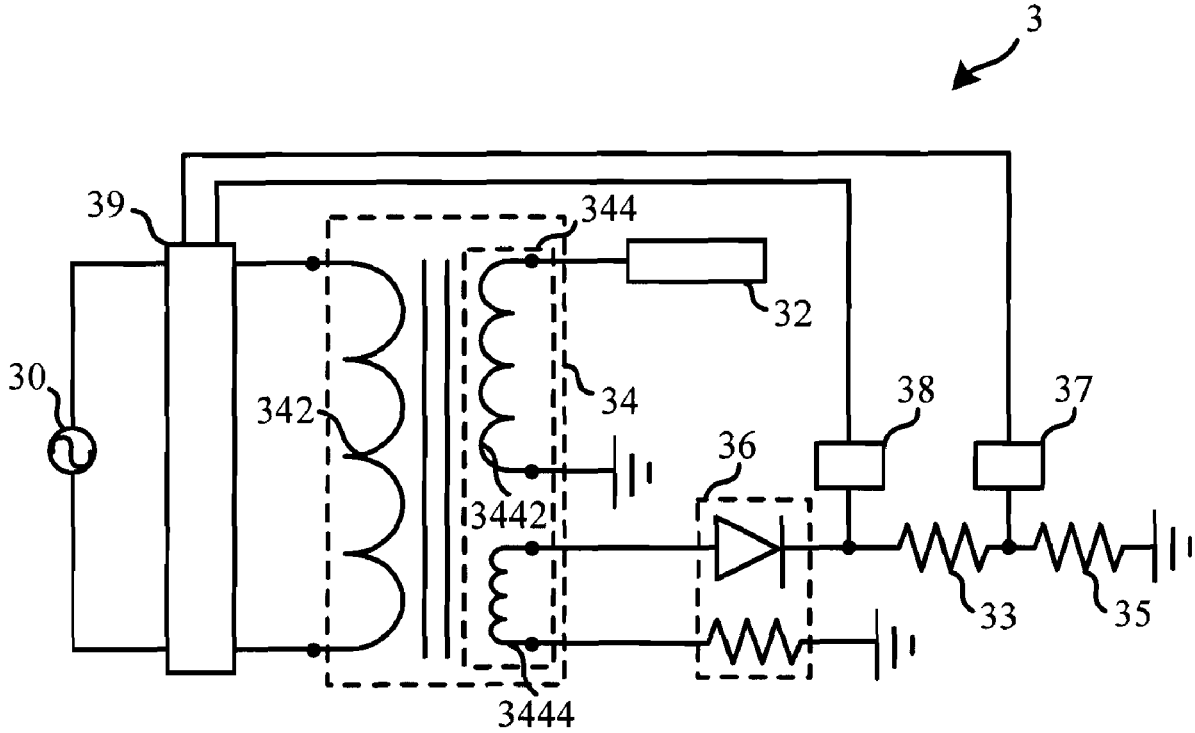
FIG. 3 is a schematic diagram illustrating another connecting pattern of the backlight apparatus shown in FIG. 2.

Please refer to FIG. 3. Except that the connecting pattern of detecting circuit 26 in FIG. 2 adopts the center-tapped connecting pattern to connect with the secondary winding 244 of the balance transformer 24, FIG. 3 is a schematic diagram illustrating another connecting pattern of the backlight apparatus shown in FIG. 2, to divide a secondary winding 344 into a first secondary winding 3442 and a second secondary winding 3444 in a balance transformer 34.

In FIG. 3, the first secondary winding 3442, which is corresponding to a primary winding 342 and coupled to a lamp 32, is used for generating a driving current to drive the lamp 32.

The second secondary winding 3444, which is corresponding to the primary winding 342 and coupled to a detecting circuit 36, is used for transmitting the driving current to the detecting circuit 36. Besides, the second secondary winding 3444 can be coupled to a first impedance 33 for generating a current through the first impedance 33. The connecting pattern shown in FIG. 3 is connecting the detecting circuit 36 or the first impedance 33 with the second secondary winding 3444, which is called third winding method.

The measuring module 37 measures value of a second voltage between the first impedance 33 and the second impedance 35. Afterward, the controlling module 39 will control a power source 30 according to the value of the second voltage measured by the measuring module 37.

Figure 4:
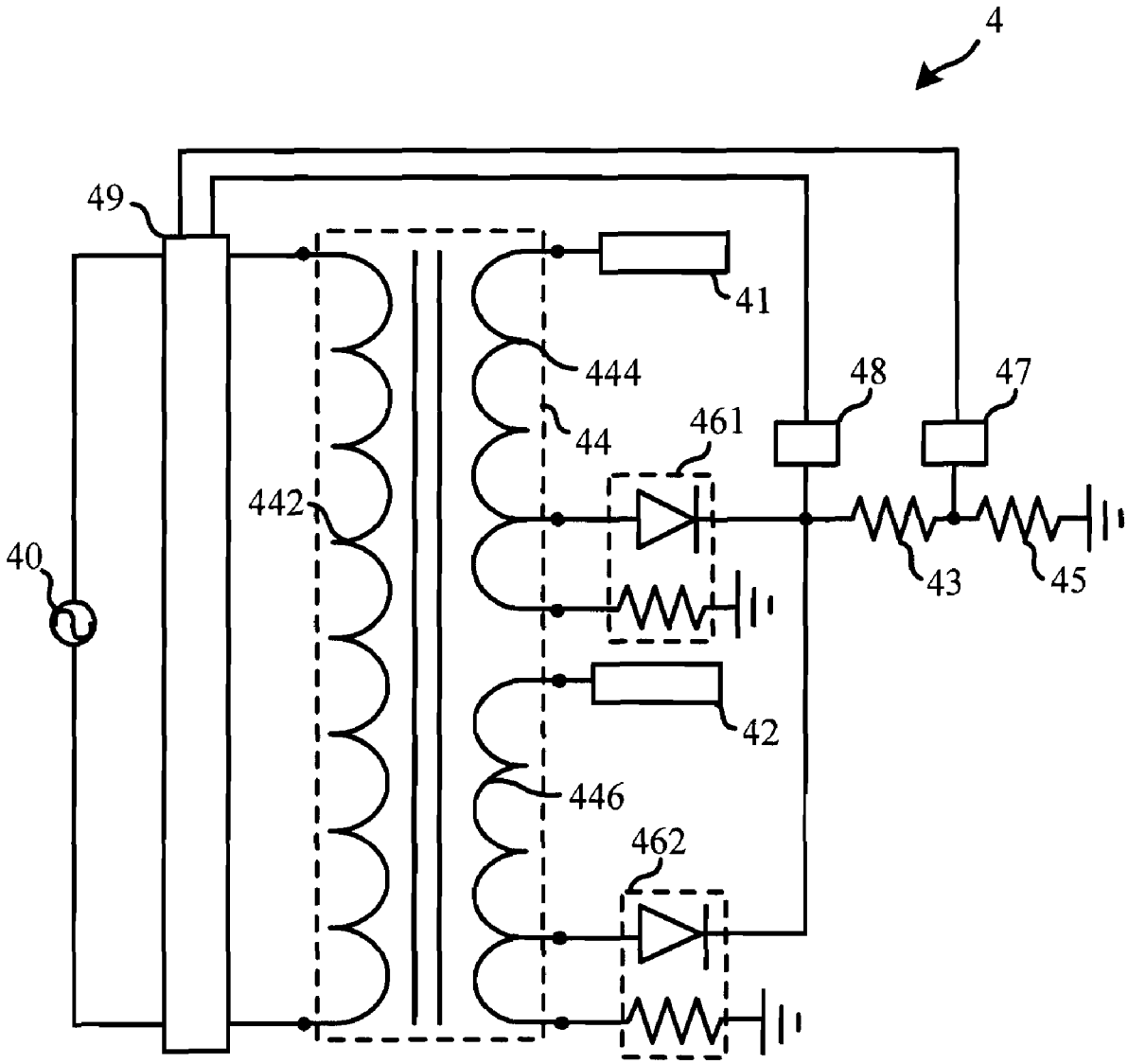
FIG. 4 is a schematic diagram illustrating a second embodiment of a backlight apparatus.

A second embodiment of the invention is also a backlight apparatus. Please refer to FIG. 4. FIG. 4 is a schematic diagram illustrating a second embodiment of a backlight apparatus.

In FIG. 4, the backlight apparatus 4 comprises a power source 40, a first lamp 41, a second lamp 42, a balance transformer 44, a first detecting circuit 461, a second detecting circuit 462, a judging module 48, a first impedance 43, a second impedance 45, a measuring module 47, and a controlling module 49. Due to that the balance transformer 44 is corresponding to two lamps (first lamp 41 and second lamp 42), the balance transformer 44 is one-balance-transformer-to-two-lamp (singular to double).

The following is a detailed introduction to the mutual relationship and function of each unit included in the multi-lamp backlight apparatus 4.

The balance transformer 44 comprises a primary winding 442, a first secondary winding 444, and a second secondary winding 446. The primary winding 442 is electrically connected to the power source 40. The first secondary winding 444, corresponding to the primary winding 442, is coupled to the first lamp 41. The second secondary winding 446, corresponding to the primary winding 442, is coupled to the second lamp 42.

The first detecting circuit 461 and the second detecting 462 circuit are respectively connected to the first secondary winding 444, while the second secondary winding 446 of the balance transformer 44 is used for respectively detecting a first current generated by the first secondary winding 444, and a second current generated by the second secondary winding 44. Then, the detecting circuits generate a first voltage according to the first current and the second current. In fact, both the first current and the second current are induction currents.

It should be noticed that, in FIG. 4, the first detecting circuit 461 and the second detecting circuit 462 adopt center-tapped connecting pattern to connect with the first secondary winding 444 and the second secondary winding 446 of balance transformer 44.

The judging module 48, which is electrically connected to the first detecting circuit 461 and the second detecting circuit 462, is used for judging whether the value of the first voltage is smaller than a default value. Based on it, the judging module 48 can determine whether the first detecting circuit 461 and the second detecting circuit 462 are short.

The controlling module 49, which is electrically connected to the power source 40 and the judging module 48, is used for controlling the power source 40 according to a judgment of judging module 48. In practical application, the controlling module 49 may comprise a full-bridge circuit or a half-bridge circuit. If the judgment made by the judging module 48 is positive, the controlling module 49 will turn off the power source 40 to protect the backlight apparatus 4.

In addition, the backlight apparatus 4 comprises the first impedance 43, the second impedance 45, and the measuring module 47. In practical application, the first impedance 43 and the second impedance 45 can each be a resistor component.

The first impedance 43 is electrically connected to the first secondary winding 444 and the second secondary winding 446. A current flows through the first impedance 43 comprise a first current generated by the first secondary winding 444 and a second current generated by the second secondary winding 446. The second impedance 45 is coupled to the first impedance 43.

The measuring module 47, which is coupled between the first impedance 43 and the second impedance 45, is used for measuring value of a second voltage between the first impedance 43 and the second impedance 45. In fact, the value of the second voltage measured by the measuring module 47 is a kick-off voltage value to activate a lamp.

The controlling module 49, which is electrically connected to the power source 40 and the measuring module 47, is used for controlling the voltage, provided by the power source 40, according to the value of the second voltage. In this way, the voltage feedback compensation is achieved in close loop.

Figure 5:
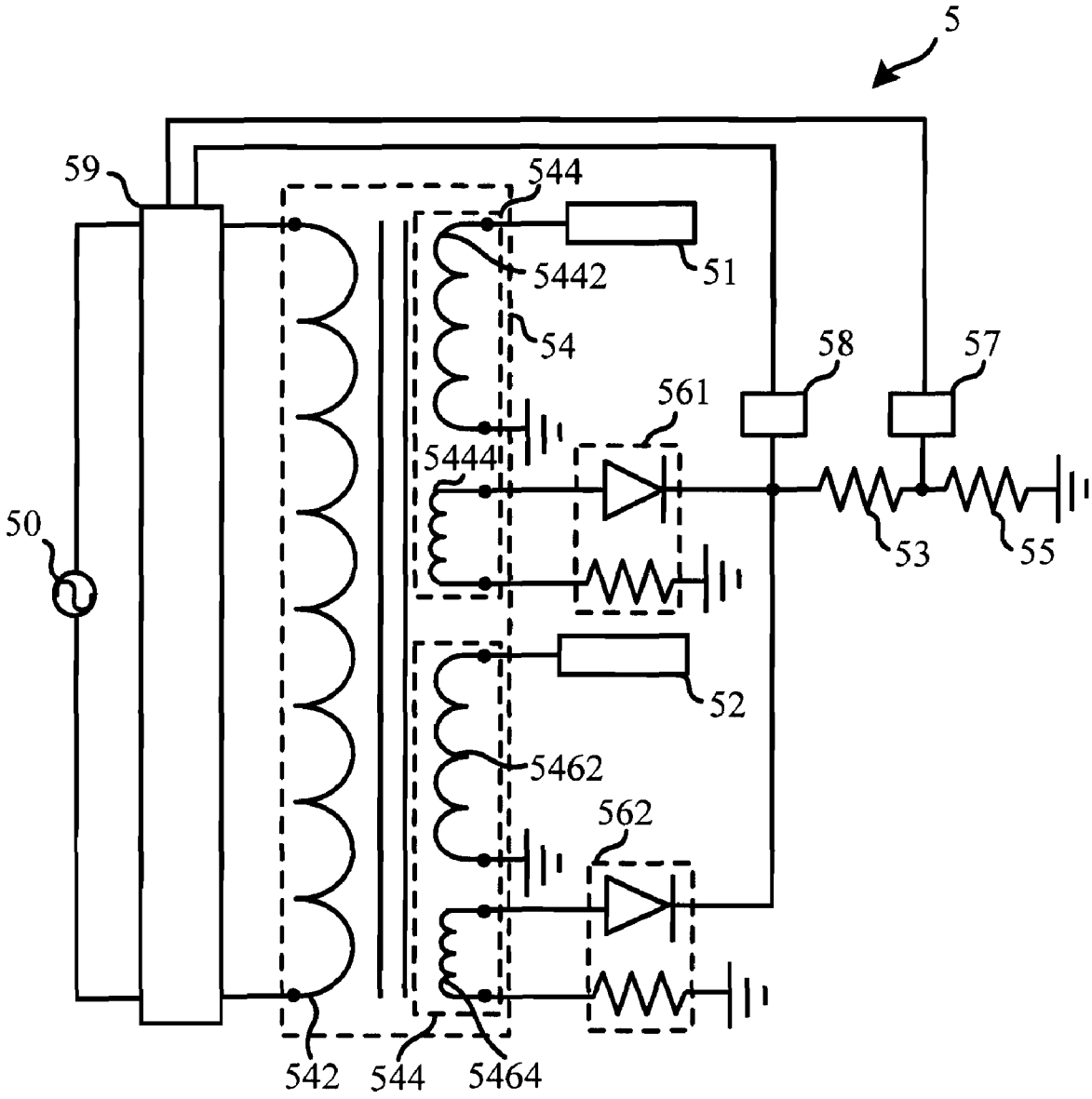
FIG. 5 is a schematic diagram illustrating another connecting pattern of the backlight apparatus shown in FIG. 4.

Please refer to FIG. 5. Except the center-tapped connecting pattern in FIG. 4, FIG. 5 is a schematic diagram illustrating another connecting pattern of the backlight apparatus shown in FIG. 4, to divide a first secondary winding 544 into a first sub-winding 5442 and a second sub-winding 5444 in a balance transformer 54.

In FIG. 5, the first sub-winding 5442, corresponding to a primary winding 542 and coupled to a first lamp 51, is used for generating a driving current to drive the first lamp 51.

The second sub-winding 5444, corresponding to the primary winding 542, is coupled to a detecting circuit 56. Besides, the second sub-winding 5444, which might be coupled to a first impedance 53, is used for generating a current that flows through the first impedance 53. The connecting pattern shown in FIG. 5 is the third winding method.

Furthermore, the second secondary winging 546 may be divided into a third sub-winding 5462 and a fourth sub-winding 5464. The connection pattern is the same as the aforesaid pattern.

The measuring module 57 measures the value of a second voltage between the first impedance 53 and the second impedance 55. Afterward, the controlling module 59 will control a power source 50 according to value of the second voltage measured by the measuring module 57.

Figure 6:
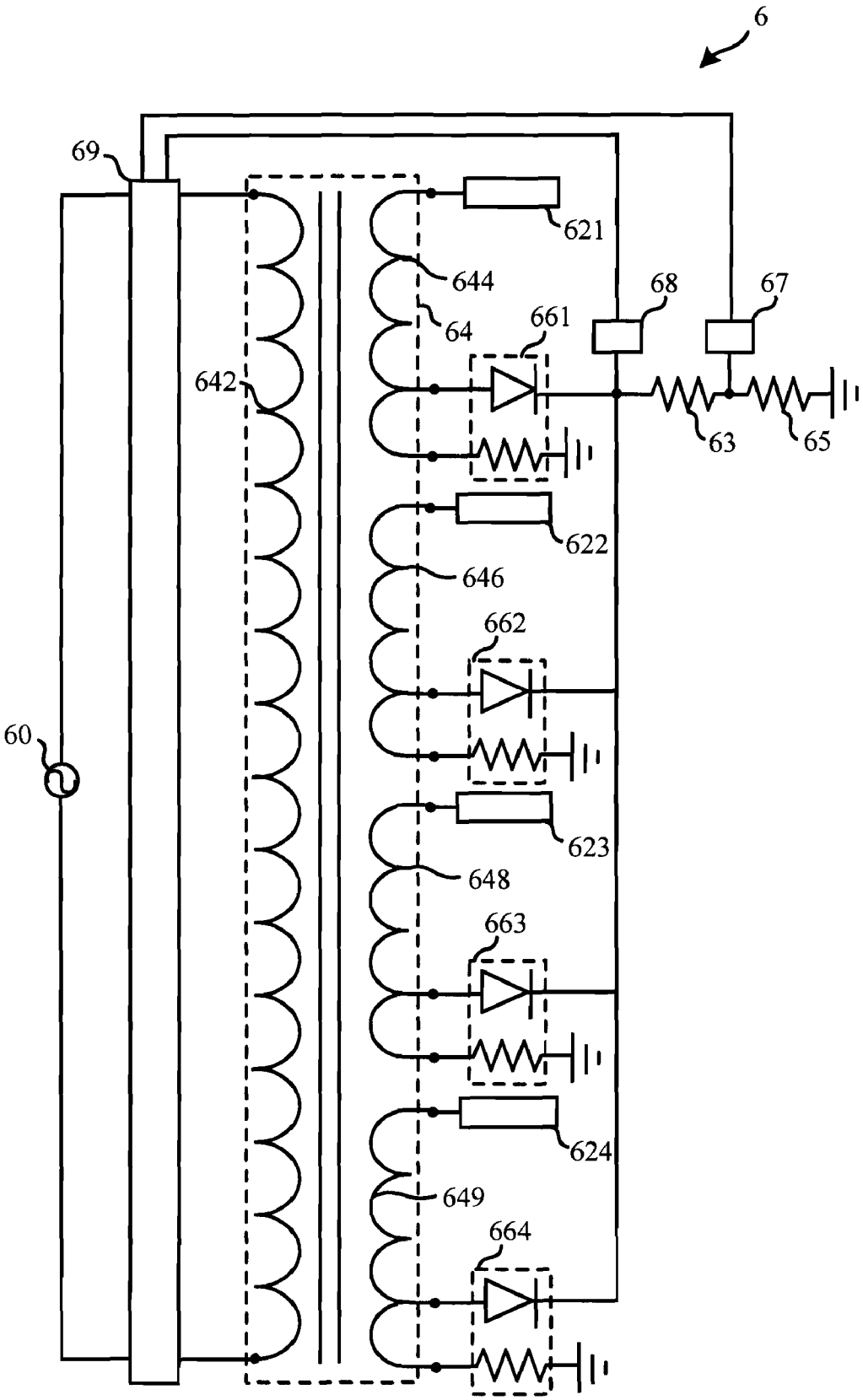
FIG. 6 is a schematic diagram illustrating a third embodiment of a backlight apparatus.

A third embodiment of the invention is also a backlight apparatus. Please refer to FIG. 6. FIG. 6 is a schematic diagram illustrating a third embodiment of a backlight apparatus.

In FIG. 6, the backlight apparatus 6 comprises a power source 60, a first lamp 621, a second lamp 622, a third lamp 623, a balance transformer 64, a first detecting circuit 661, a second detecting circuit 662, a third detecting circuit 663, a fourth detecting circuit 664, a judging module 68, a first impedance 63, a second impedance 65, a measuring module 67, and a controlling module 69. Due to that the balance transformer 44 is corresponding to four lamps (first lamp 621, second lamp 622, third lamp 623, fourth lamp 624), the balance transformer 64 is one-balance-transformer-to-four-lamp (singular to quad).

The following is a detailed introduction to the mutual relationship and function of each unit included in the multi-lamp backlight apparatus 6.

The balance transformer 64 comprises a primary winding 642, a first secondary winding 644, a second secondary winding 646, a third secondary winding 648, and a fourth secondary winding 649. The primary winding 642 is electrically connected to the power source 60. The first secondary winding 644, corresponding to the primary winding 642, is coupled to the first lamp 621. The second secondary winding 646, corresponding to the primary winding 642, is coupled to the second lamp 622. The third secondary winding 648, corresponding to the primary winding 642, is coupled to the third lamp 623. The fourth secondary winding 649, corresponding to the primary winding 642, is coupled to the fourth lamp 624.

The first detecting circuit 661, the second detecting 662 circuit, the third detecting 663, and the fourth detecting circuit 664 are respectively connected to the first secondary winding 644, the second secondary winding 646, the third secondary winding 648, and the fourth secondary 649 of the balance transformer 64. Those detecting circuits are used for respectively detecting a first current generated by the first secondary winding 644, a second current generated by the second secondary winding 646, a third current generated by the third secondary winding 648, and a fourth current generated by the fourth secondary winding 649. Then, the detecting circuits generate a first voltage according to the first current, the second current, the third current, and the fourth current. In fact, the first current, the second current, the third current, and the fourth current are all induction currents.

It should be noticed that, in FIG. 6, the balance transformer 64 adopt center-tapped connecting pattern to connect with the first secondary winding 644, the second secondary winding 646, the third secondary winging 648, and the fourth secondary winding 649 of the balance transformer 64.

The judging module 68, which is electrically connected to the first detecting circuit 661, the second detecting circuit 662, the third detecting circuit 663, and the fourth detecting circuit 664, is used for judging whether the value of the first voltage is smaller than a default value. Based on it, the judging module 68 can determine whether those detecting circuits are short.

The controlling module 69, which is electrically connected to the power source 60 and the judging module 68, is used for controlling the power source 60 according to a judgment made by the judging module 68. If the judgment made is that the detecting circuits 66 are short, the controlling module 69 will turn off the power source 60 to protect the backlight apparatus 6.

In addition, the backlight apparatus 6 comprises the first impedance 63, the second impedance 65, and the measuring module 67. In practical application, the first impedance 63 and the second impedance 65 can each be a resistor component.

The first impedance 63 is electrically connected to the first secondary winding 644, the second secondary winding 646, the third secondary winding 648, and the fourth secondary winding 649. A current flows through the first impedance 63, comprises a first current generated by the first secondary winding 644, a second current generated by the second secondary winding 646, a third current generated by the third secondary winding 648, and the a fourth current generated by the fourth secondary winding 649. The second impedance 65 is coupled to the first impedance 63.

The measuring module 67, which is coupled between the first impedance 63 and the second impedance 65, is used for measuring the value of a second voltage between the first impedance 63 and the second impedance 65. In fact, the value of the second voltage measured by the measuring module 67 is a kick-off voltage value to activate a lamp.

The controlling module 69, which is electrically connected to the power source 60 and the measuring module 67, is used for controlling the voltage provided by the power source 60, according to the value of the second voltage. In this way, the voltage feedback compensation is achieved in close loop.

Figure 7:
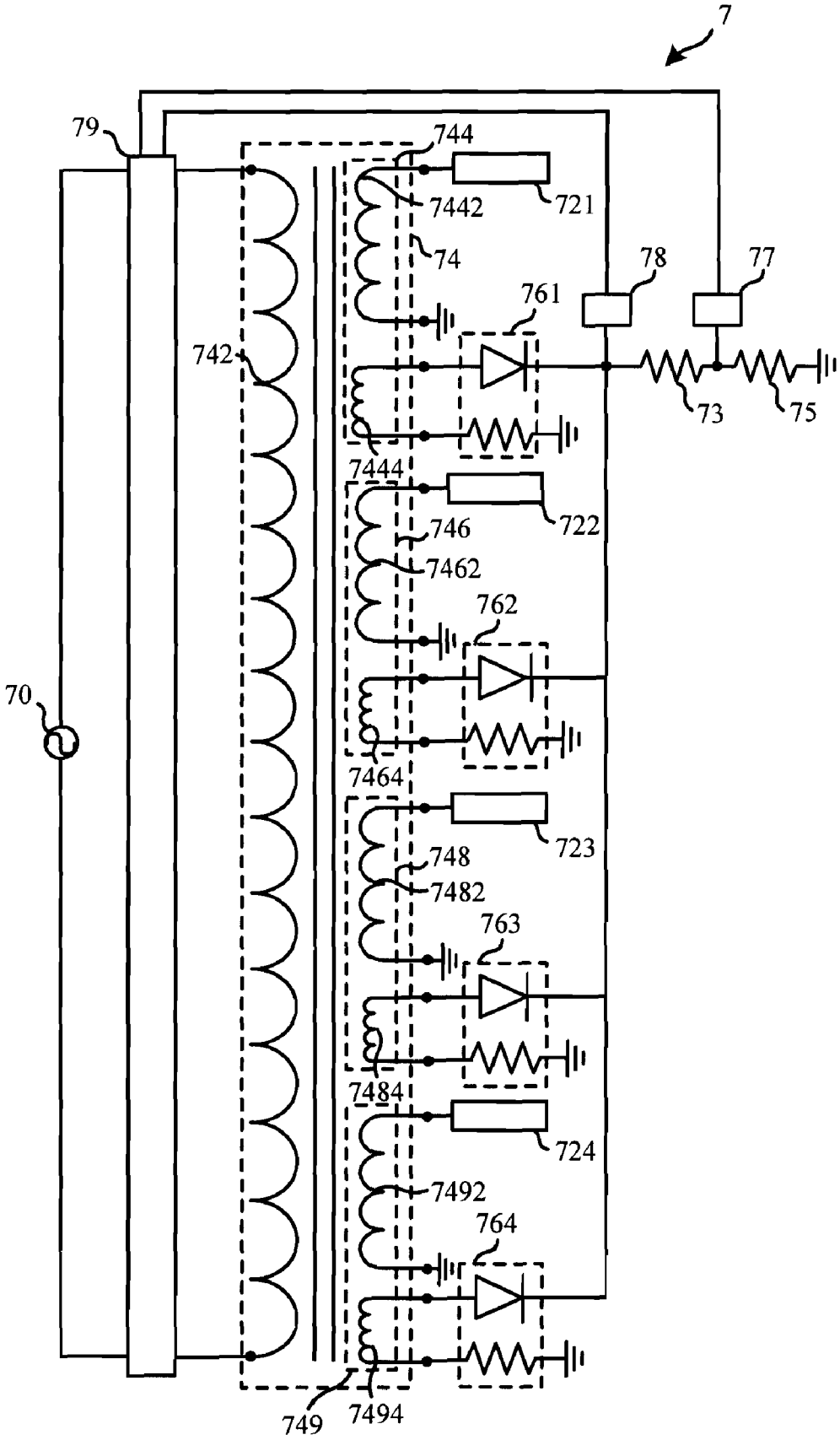
FIG. 7 is a schematic diagram illustrating another connecting pattern of the backlight apparatus shown in FIG. 6.

Please refer to FIG. 7. Except the center-tapped connecting pattern in FIG. 6, FIG. 7 is a schematic diagram illustrating another connecting pattern of the backlight apparatus shown in FIG. 6, to divide a first secondary winding 744 into a first sub-winding 7442 and a second sub-winding 7444 in a balance transformer 74.

In FIG. 7, the first sub-winding 7442, corresponding to a primary winding 742 and coupled to a first lamp 721, is used for generating a driving current to drive the first lamp 721.

The second sub-winding 7444, which corresponds to the primary winding 742, is coupled to a detecting circuit 76. Besides, the second sub-winding 7444, which might be coupled to a first impedance 73, is used for generating a current flowing through the first impedance 73. The connecting pattern shown in FIG. 7 is the third winding method.

Furthermore, the second secondary winding 746, the third secondary winding 748, and the fourth secondary winding 749 respectively comprise a third sub-winding 7462, a fourth sub-winding 7464, a fifth sub-winding 7482, a sixth sub-winding 7484, a seventh sub-winding 7492, and a eighth sub-winding 7494. The connection pattern is the same as the aforesaid pattern.

The measuring module 77 measures the value of a second voltage between the first impedance 73 and the second impedance 75. Afterward, the controlling module 79 will control a power source 70 according to the value of the second voltage measured by the measuring module 77.

Compared to the prior art, the backlight apparatus of the invention can achieve short prevention in balance circuit and real signal voltage feedback compensation in close loop of a single-sided printed circuit board (PCB). Most importantly, the backlight apparatus of the invention can achieve the aforesaid ambition only through changing the connecting pattern of balance transformer circuit. Therefore, it can save a lot of capacitors and resistors and reduce product cost.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A backlight apparatus, comprising:

a power source;

a lamp;

a balance transformer, comprising:

a primary winding electrically connected to the power source; and a secondary winding corresponding to the primary winding and electrically connected to the lamp, the secondary winding comprising:

a first secondary winding, corresponding to the primary winding and coupled to the lamp, for generating a driving current to drive the lamp; and a second secondary winding, corresponding to the primary winding, for transmitting a current;

a detecting circuit, electrically connected to the second secondary winding of the secondary winding, for receiving and detecting the current generated by the second secondary winding of the secondary winding and generating a first voltage according to the current;

a judging module, electrically connected to the detecting circuit, for judging whether a value of the first voltage is smaller than a default value; and a controlling module, electrically connected to the power source and the judging module, for controlling the power source according to a judgment made by the judging module.

2. The backlight apparatus of claim 1, wherein the controlling module comprises a full-bridge circuit or a half-bridge circuit.

* * * * *